US005228945A

United States Patent [19]

Labbé

[11] Patent Number: 5,228,945

[45] Date of Patent: Jul. 20, 1993

[54] LABEL PLACEMENT MACHINE

[76] Inventor: Gabriel Labbé, 196 de l'Eglise Honfleur, Québec, Province of Québec, Canada, G0R 1N0

[21] Appl. No.: 794,899

[22] Filed: Nov. 20, 1991

[51] Int. Cl.[5] ..... B65C 7/00

[52] U.S. Cl. ..... 156/571; 156/443; 156/468; 156/475; 156/565

[58] Field of Search ..... 156/570, 571, 227, 443, 156/468, 475, DIG. 3, DIG. 4, DIG. 5, DIG. 30, DIG. 31, DIG. 42, 565; 221/210, 211

[56] References Cited

U.S. PATENT DOCUMENTS

| | | | |
|---|---|---|---|
| 2,626,074 | 1/1953 | Vogt | 156/571 X |
| 2,676,726 | 3/1954 | Von Hofe | 156/571 X |
| 2,726,003 | 12/1955 | Govatsos | 156/571 X |
| 2,805,060 | 9/1957 | Lefier | 271/11 |
| 2,816,760 | 12/1957 | Seragnoil | 271/20 |
| 3,259,384 | 7/1966 | Hittenberger | 271/62 |
| 4,181,561 | 1/1980 | Seragnoli | 156/475 X |
| 4,425,181 | 1/1984 | Bahr et al. | 156/497 |
| 4,457,801 | 7/1984 | Zodrow | 156/565 X |
| 4,505,467 | 3/1985 | Brocklehurst | 270/53 |
| 4,564,188 | 1/1986 | McNair | 271/103 |
| 4,696,715 | 9/1987 | Bahr | 156/571 X |
| 4,889,581 | 12/1989 | Ulrich et al. | 156/468 X |

*Primary Examiner*—David A. Simmons
*Assistant Examiner*—James J. Engel, Jr.
*Attorney, Agent, or Firm*—Jon L. Roberts

[57] ABSTRACT

The present invention discloses an apparatus which selects a label from a stack thereof, folds it on a predetermined fold line, and then applies the folded label in a predetermined location on a product.

11 Claims, 6 Drawing Sheets

FIG. 6
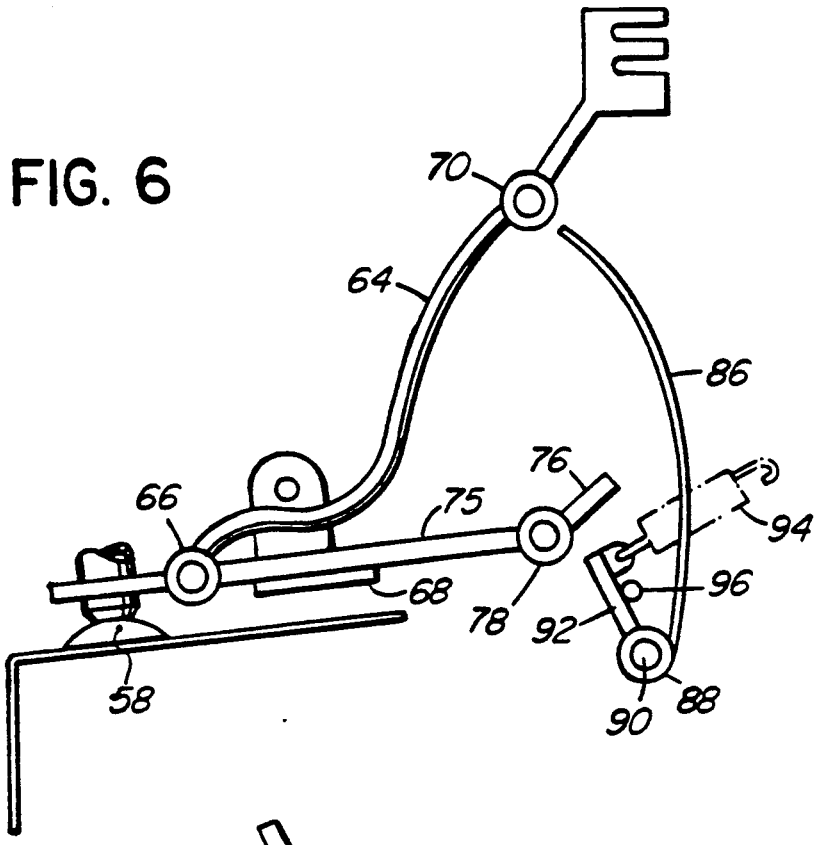
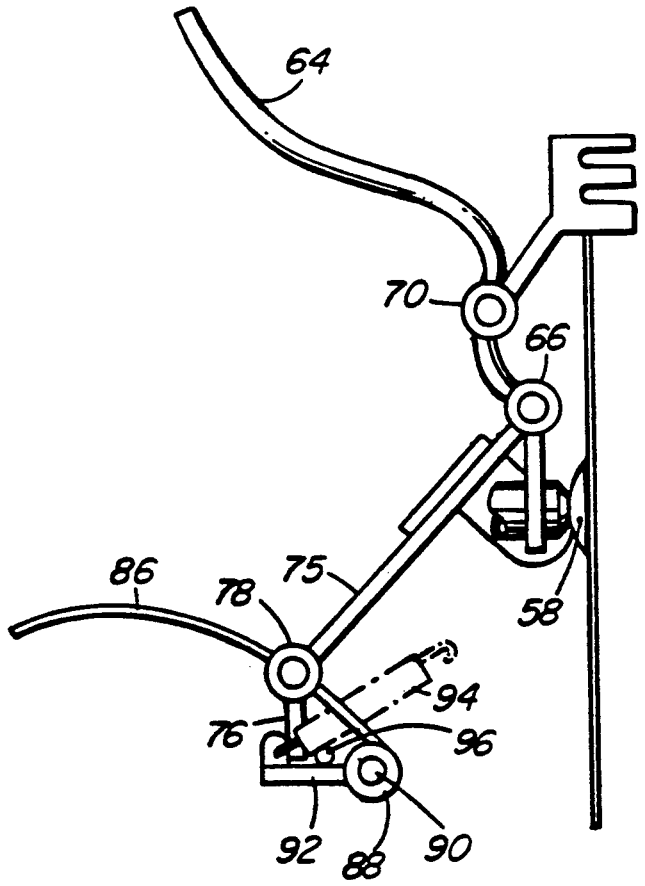
FIG. 7

LABEL PLACEMENT MACHINE

The present invention relates to an apparatus for selecting, folding and applying a label in a predetermined location on a product.

BACKGROUND OF THE INVENTION

Fruit juices and various types of beverages are available in square cardboard type boxes, either in 250 milliliter or 200 milliliter sizes, some of which are known as Tetra-packs TM. The packages often comprise an exterior plastic coating and an interior aluminum coating and are wrapped in a plastic covering. Promotional material or advertising is generally printed on the outside of the packages. When a company marketing such packages requires a change in the advertisement, the design of the package has to be changed. This is a rather costly undertaking since it requires the entire package to be reprinted, especially where the packages comprise an exterior plastic coating and an interior aluminum coating as described above. It is desirable that an inexpensive way of changing the printing on the packaging be made possible. In order to accommodate this requirement coupons which are normally made from cardboard are placed over the packages within the plastic covering, thus providing a means for adding promotional advertising items to the packaging. The expense of printing the coupons is much less in comparison to the cost of changing the packaging. The placing of the ticket or coupon inside the plastic wrap has the advantage that it renders it less likely to be removed by the consumer who does not purchase the item. This has been found to be a particular problem in the past. Accordingly, there has been a need for an apparatus which would automatically apply or place these coupons over the package.

SUMMARY OF THE INVENTION

The present application addresses the requirement for a label folding and applying device which selects a label from a stack of labels, folds the label on a predetermined fold line and then applies the folded label in a predetermined location on a product.

According to a broad aspect of the present invention, there is provided a label folding and applying apparatus comprising a channel assembly which holds a stack of cardboard labels in a generally upright position and defines a path between the stacked position and the position at which the label is applied to a product, a label feed assembly for grasping the first label in the stack of labels, moving it along the aforementioned path and applying it in a predetermined location on the product, means biasing said stack of labels towards said label feed assembly and a label folding assembly positioned in the aforementioned path and cooperable with the feed assembly for folding the label along a transverse fold line as the feed assembly moves the label along the path.

BRIEF DESCRIPTION OF THE DRAWINGS

These and other features of the invention will become more apparent from the following description in which reference is made to the appended drawings wherein:

FIG. 6 is a simplified view, partly in section, of FIG. 1 illustrating the interaction between some of the elements shown; and FIG. 7 is a simplified view, partly in section, of FIG. 5 illustrating the interaction between some of the elements shown.

DESCRIPTION OF THE PREFERRED EMBODIMENT

Figure 1:
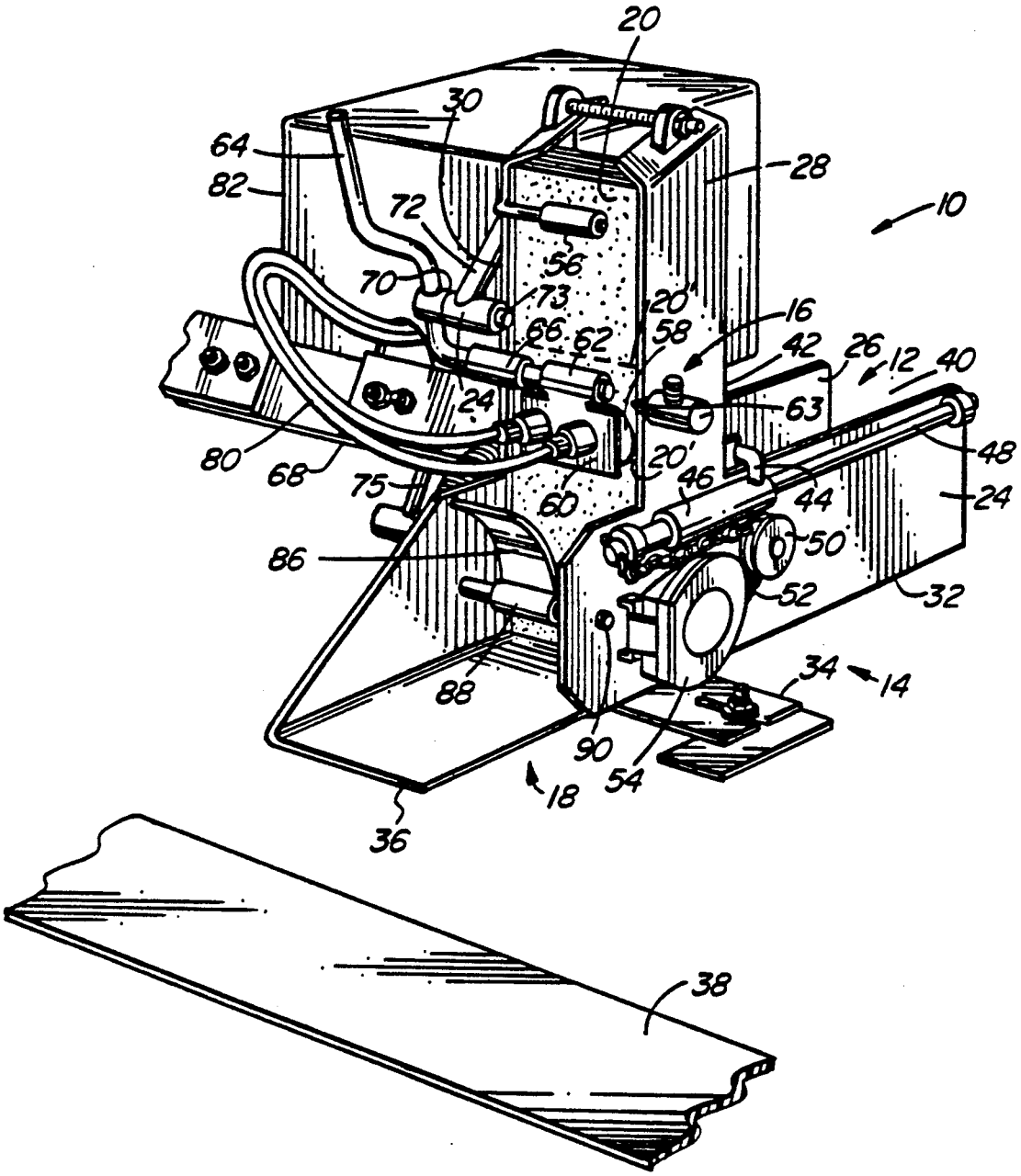
FIG. 1 is a perspective view of one embodiment of the present invention illustrating the first step in the folding process.
Figure 2:
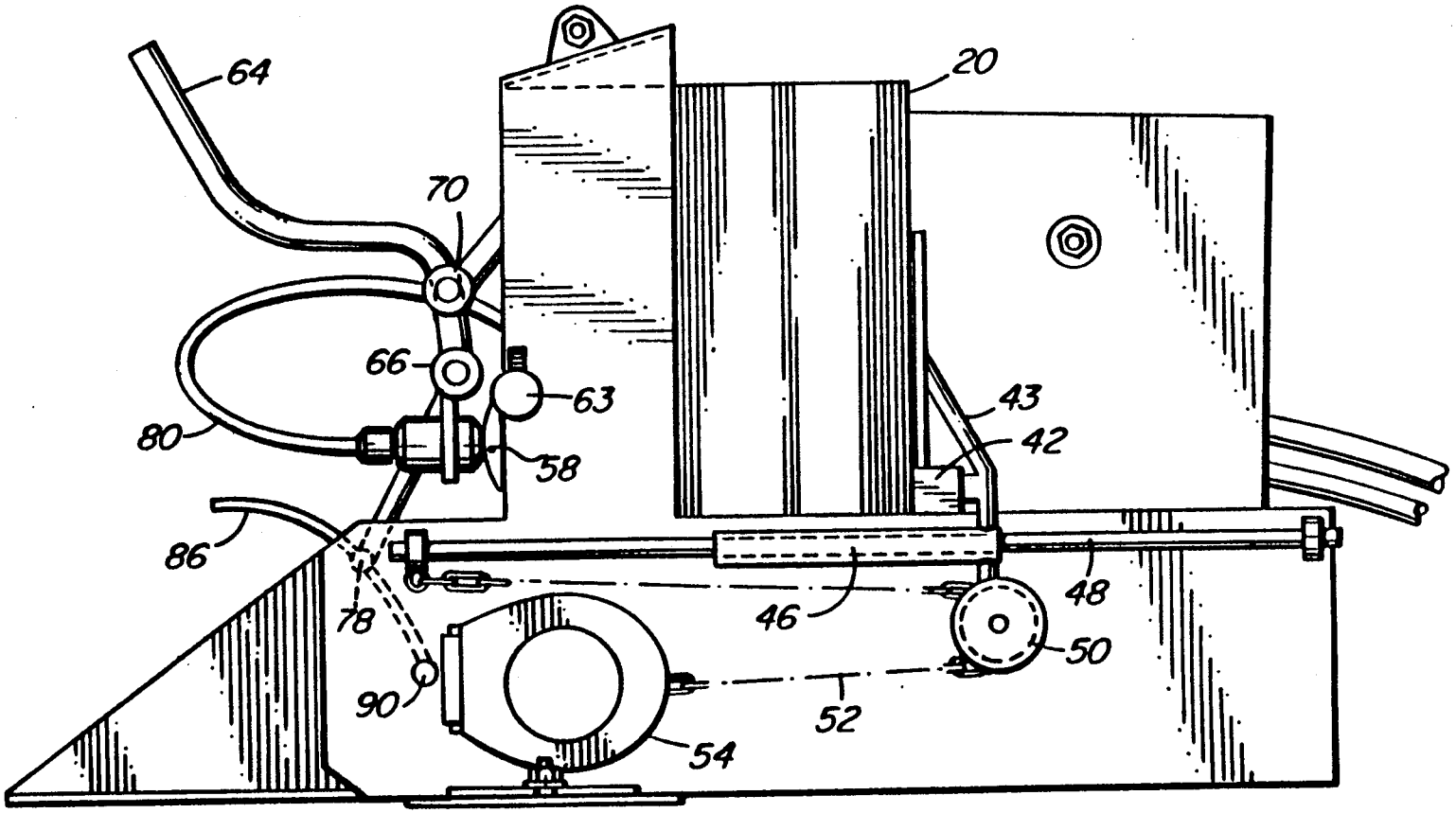
FIG. 2 is a side view of FIG. 1.
Figure 5:
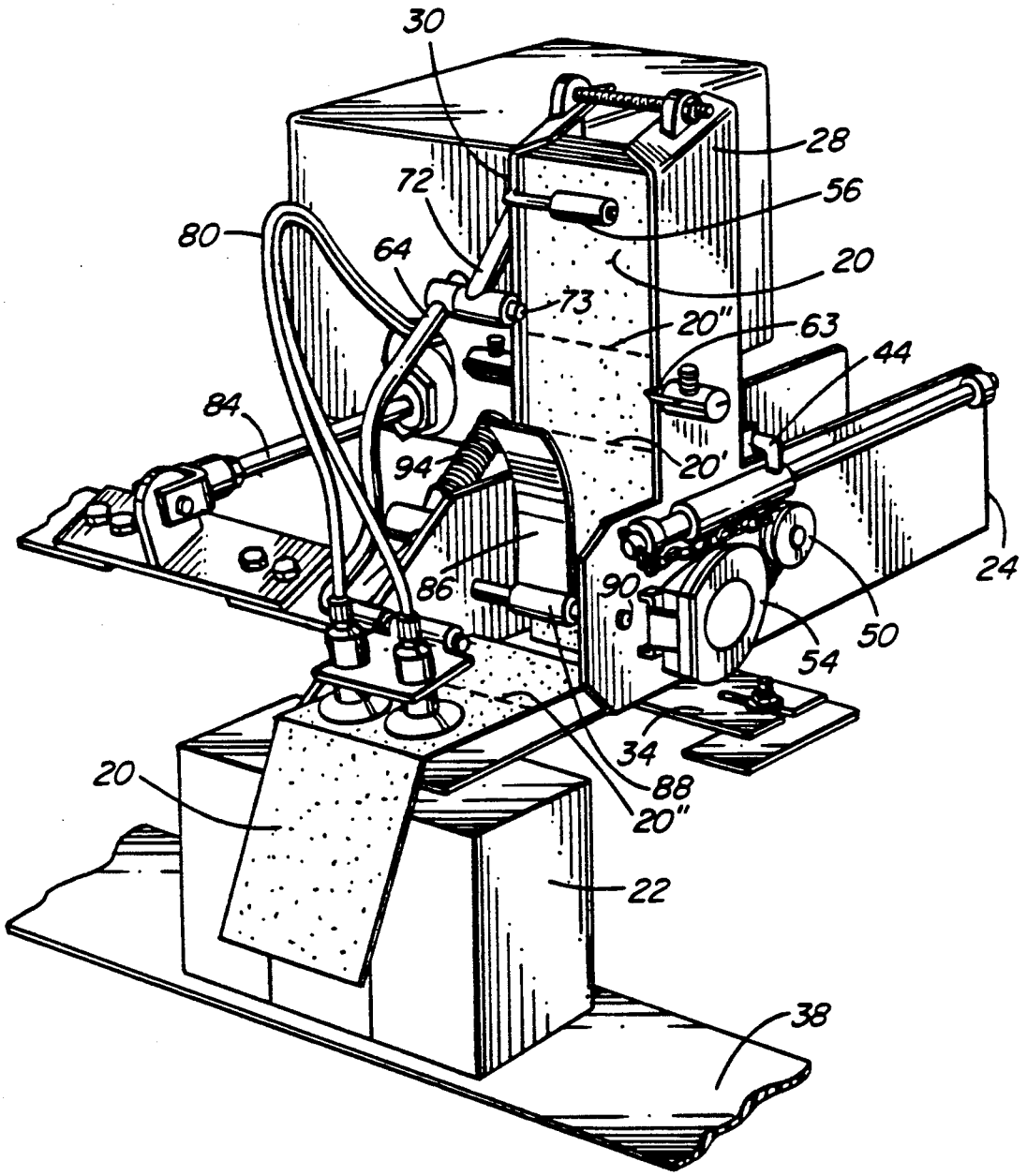
FIG. 5 is a perspective view of the invention with a label about to be applied to a product.

Referring to FIG. 1, a label folder/applicator shown generally at 10 comprises a channel assembly 12, a label biasing assembly 14, a label feed assembly 16 and a label folding assembly 18. The channel assembly 12 holds a stack of cardboard labels 20 in an upright vertical position and defines a path between the stacked position and the position at which the label 20 is applied to a product 22. The labels 20 have been prefolded transversely along two lines illustrated as 20' and 20'' (FIG. 5). The channel assembly 12 comprises a pair of spaced apart laterally extending sidewalls 24 and 26. Upwardly extending members 28 and 30 are secured to the proximal end of sidewalls 24 and 26 respectively.

The sidewalls 24 and 26 are secured to a flat base member 32 having a flange 34 extending outwardly thereof and which can be secured to any suitable work surface. The base member 32 has a lip type projection 36, under which the product 22 to which the label 20 is to be applied moves, usually along a conveyor belt 38. The sidewalls 24 and 26 and the base member 32 form a U-shaped channel or magazine 40 which serves to hold the stack of labels 20.

The label biasing assembly 14 comprises a block member 42 adapted to fit within the channel 40 against the bottom portion of the last label of the stack of labels 20. A label retaining arm 43 is secured to the top distal edge of the block member 42. The arm 43 is secured to a generally U-shaped elongated member 44 which extends along the top distal edge of the block member 42 and over the top edges of the sidewalls 24 and 26. The member 44 is secured to a runner 46 which slides over a linear guide 48 secured to the sidewall 24 adjacent the upper edge thereof. An idler pulley 50 is secured to the runner 46 and a chain 52 is attached at one end to a spring-loaded reel 54 which draws in the chain 52, over the pulley 50, thereby applying pressure to the label stack 20 via the runner 46, and the block member 42.

A roller 56 is secured to the proximal edge of the upwardly extending member 30 and extends partly across the top portion of the first label and serves to retain the labels 20 in an upright position within the channel 40.

The label feed assembly 16 for grasping the first label in the stack of labels 20 and applying it in a predetermined location on the product 22 comprises a pair of suction cups 58 fixed to a metal plate 60 having a sleeve 62. A pair of knives 63 secured to the outside walls of the upwardly extending members 28 and 30 ensure withdrawal of only one label at a time. Plate 60 mounting the suction cups 58 is secured to a lazy 'S'-shaped lever 64 by way of a pin and sleeve arrangement 66, one end of which is secured to the metal plate 60 while the other end is secured to a plate member 68. The lever 64 is mounted to a pivot 70 attached by way of a cross-arm 72 to the outside wall 74 of the upwardly extending arm 30. The pivot 70 consists of a pin 73 pivotally mounted in a bushing 74. The pin 73 has an aperture therethrough, in which lever 64 can operate. An arm 75 is fixed to the plate member 68 and as illustrated in FIGS. 6 and 7, arm 75 has an end portion 76 that moves about pivot 78.

The suction cups 58 are connected via a vacuum hose 80 to a vacuum generation unit 82 which provides the vacuum pressure for the system. A piston 84 is pivotally secured to the plate member 68. The movement of the piston 84 in its cylinder in combination with the lever 64 causes the suction cups 58 to grip the first label in the stack and move it to its position on the product 22, as explained hereafter.

The label folding assembly 18 includes a curved wiper member 86 positioned within the U-shaped channel 40 adjacent the lower end of the first label of the stack of labels. The lower end of the wiper member 86 has a sleeve 88 on a pin 90 which extends transversely across the channel 40 and is secured to the sidewalls 24 and 26. A latch 92 is secured to the pin member 90 and the free end of the latch 92 is held to the outside wall 74 of upwardly extending member 30 by means of a spring 94. A stopper 96 is also secured adjacent the spring 94 on the outside wall 74. The wiper member 86 moves from a first position where it extends away from the stack of labels to a second position where it is biased against the stack of labels. This will be described in more detail below.

Figure 3:
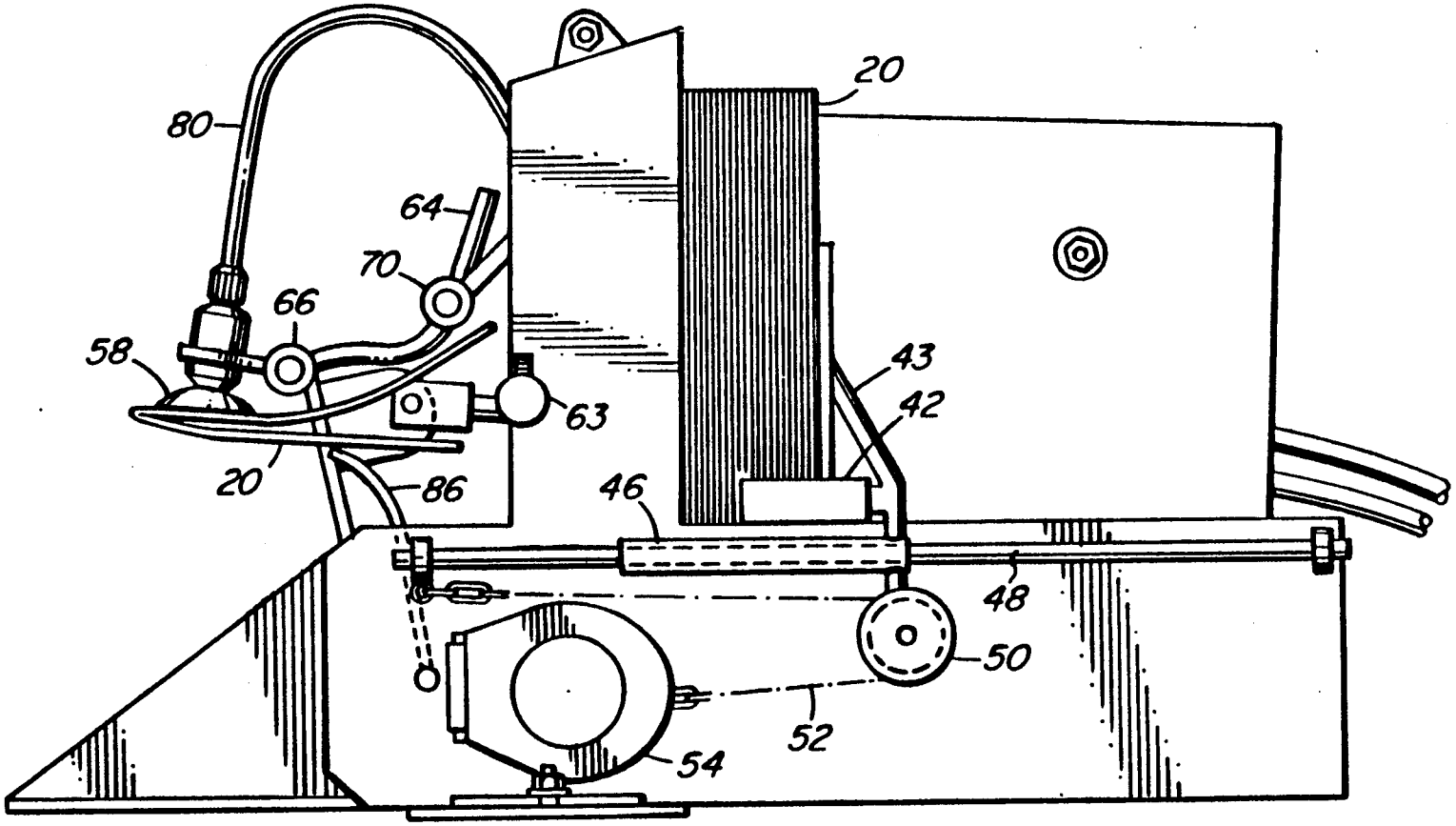
FIG. 3 is a side view showing a further step in the folding process.
Figure 4:
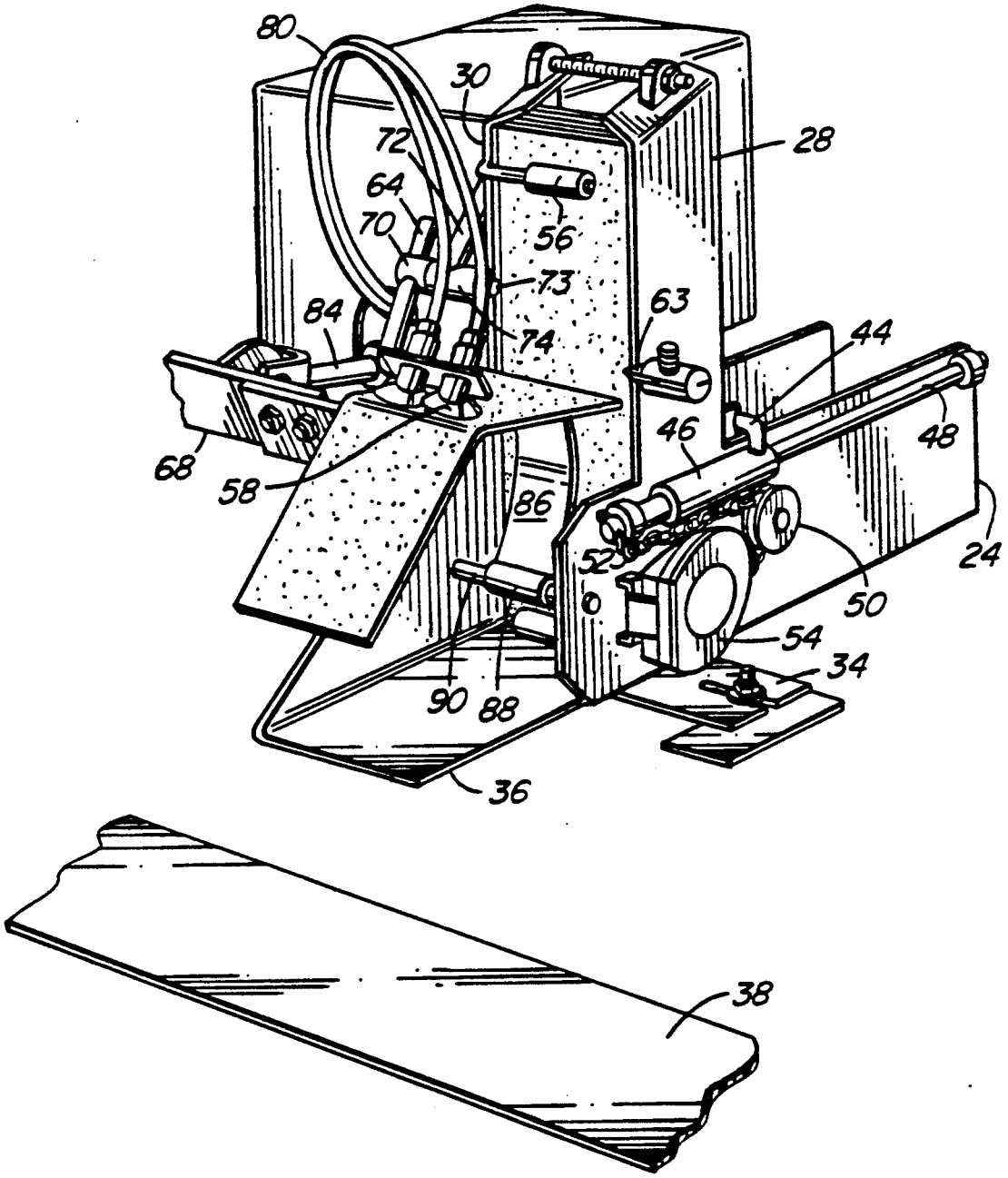
FIG. 4 is a side view showing a further step in the folding process.

FIGS. 1 to 5 show the operation of the device from feeding the label from the stack of labels to folding the label, to applying the label on the product. The operation of the device is as follows. As illustrated in FIG. 1, the suction cups 58 secured to the lever 64, are operable using the vacuum generation unit 82 to grip the first label 20 in the stack between the two pre-fold lines 20' and 20'' along which the label 20 is to be folded. The knives 63 ensure withdrawal of a single label 20. In this position, as illustrated in FIG. 7, the end portion 76 of the arm 75 is engaged by the latch 92. As the vacuum generation unit 82 is activated, the piston 84 moves outwardly causing the plate member 68 and the arm 75 to start rotating counterclockwise. As a result, the lever 64 travels downward through the pivot 70 and the end portion 76 of the arm 75 disengages from the latch 92. The force exerted by the spring 94 causes the wiper member 86 to rotate clockwise about the pin member 90 and thus pivot rearwardly towards the stack of labels. As shown in FIG. 3, as the label 20 is pulled away from the stack of labels, it is folded along pre-fold line 20' as it engages the top portion of the wiper member 86 which is rotating clockwise upon the disengagement of the end portion 76 of the arm 75 from the latch 92. As the latch comes into contact with the stopper 96, further travel of the wiper member 86 is prevented. After pivoting through about 90° such that the plane of the label is substantially horizontal, the suction cups 58 and the label 20 attached to them are shifted forwardly. As this occurs, the curved surface of the wiper member 86 slides along and applies pressure to the bottom of the label which has now been folded through 180° with respect to its upper end. As illustrated in FIG. 4, the bottom end of the label springs forwardly, to an angle of about 90° with respect to its upper end, when it comes out of engagement with the wiper member 86. As the piston 84 moves outwardly, the plate member 68 which is pivotally connected thereto rotates about 180° from its initial position. As the S-shaped lever 64 travels downwardly, the suction cups 58 also rotate 180° because of the shape of the lever 64. The feed assembly continues to move forwardly as shown in FIG. 5 to a final position where it applies the label 20 now folded along line 20' in proper position on a waiting product 22. Application of a plastic outside wrapping to the product 22 causes the label 20 to fold along second line 20''. The vacuum generation unit 82 is then deactivated causing the suction cups 58 to release the label 20. In order for the process to be repeated, the piston 84 is caused to travel rearwardly causing the lever 64 to start moving through the pivot 70 which in turn causes the plate member 68 to start rotating clockwise, eventually almost 180°. The pin and bushing arrangement 66 causes the suction cups to pivot and contact the next label in the stack. As the plate member 68 rotates, the end portion 76 of the arm 75 engages once more the latch 92 which causes counterclockwise rotation of the wiper member 86 about the shaft member 90 causing the wiper member 86 to move forwardly allowing removal of the label from the stack. The cycle is repeated.

It is possible to interconnect a pair of label folding machines 10 along a production line through the plate member 68 as illustrated in the figures. Alternatively, a single machine may be used.

It will be appreciated that variations can be made to the embodiment of the present invention without departing from the spirit and scope of the invention. I therefore wish to embody within the scope of the patent which may be granted hereon all such embodiments as reasonably and properly come within the scope of my contribution to the art.

The embodiments of the invention in which an exclusive property or privilege is claimed are defined as follows:

1. A labelling apparatus which sequentially selects a label from a stack thereof, folds the label along a predetermined fold line and then applies the label in a predetermined location on a product, said apparatus comprising:

a channel assembly which holds a stack of cardboard labels in a generally upright position and defines a path between the stacked position and the position at which the label is applied to a product;

a label feed assembly for selectively and sequentially grasping the first label in the stack of labels, moving it along the aforementioned path and positioning it in a predetermined position on the product;

means biasing said stack of labels towards said label feed assembly; and a label folding assembly positioned in the aforementioned path and cooperable with the feed assembly for folding the label along a transverse fold line as the feed assembly moves the label along said path.

2. The machine of claim 1 wherein said channel assembly comprises a pair of spaced apart upwardly extending arms dependent from a flat base member, said arms and base member forming a channel which holds said stack of labels in a generally upright position.

3. The machine of claim 2 wherein said channel extends substantially rearwardly of said upwardly extending arms.

4. The machine of claim 2 wherein said means biasing the stack of labels towards the feed assembly comprises a block member adapted to engage the last label in the said stack of labels and roller means adapted to engage the first label in the said stack of labels, said block member being biased by spring loaded means and being adapted to move along a linear path by guide means within said channel assembly.

5. The machine of claim 4 wherein the spring loaded means comprise a pulley, chain and spring loaded reel arrangement.

6. A labelling apparatus which sequentially selects a label from a stack thereof, folds the label along a predetermined fold line and then applies the label in a predetermined location on a product, said apparatus comprising:

a channel assembly which holds a stack of cardboard labels in a generally upright position and defines a path between a stacked position and a position at which the label is applied to a product, said channel assembly comprising a pair of spaced apart upwardly extending arms dependent from a flat base member, said arms and base member forming a channel which holds said stack of labels in a generally upright position;

a label feed assembly for selectively and sequentially grasping the first label in the stack of labels, moving it along the aforementioned path and positioning it in a predetermined position on the product, said label feed assembly comprising a pair of suction cups operable to grip said first label in said stack, a lever adapted to slide through pivot means secured to said channel assembly and an arm member having a pivotally movable end portion, said suction cups, lever and arm member being operatively associated with a drive mechanism for said apparatus, the lever being operatively associated with the suction cups so that upon action of the drive mechanism, the lever is adapted to cause said suction cups to grip said first label in said stack just above the transverse line along which the label is to be folded and then pivot said label about a transverse axis in the upper end of said label so that said lower end of said label moves upwardly and forwardly away from said stack and place the folded label in a proper position on said product;

means biasing said stack of labels towards said label feed assembly; and a label folding assembly positioned in the aforementioned path and cooperable with the feed assembly for folding the label along a transverse fold line as the feed assembly moves the label along said path.

7. The machine of claim 6 said lever is shaped in the form of a lazy S.

8. The machine of claim 6 wherein the label feed assembly further comprises knife means adapted to ensure withdrawal of a single label by said suction cups.

9. The machine of claim 6 wherein said folding assembly comprises a curved wiper member which is secured by pivot means within the channel adjacent the lower end of the said first label of the said stack of labels, latch means secured to said pivot means and stop means, said wiper member being biased by a spring in an initial position wherein the latch means engages the stop means and moving away from an initial position to a position away from said stack of labels upon the action of the drive mechanism whereupon the movable end portion of the arm member engages the latch means.

10. The machine of claim 9 wherein said pivot means comprise a shaft member extending through said channel.

11. A card folding machine which takes labels from a stack of labels, folds the labels along a predetermined fold line and then positions the labels in a predetermined position on a product, said machine comprising:

a channel assembly which holds a stack of cardboard labels in a generally upright position and defines a path between the stacked position and the position at which the label is applied to a product, said channel assembly comprising a pair of spaced apart upwardly extending arms dependent from a flat base member, said arms and base forming a channel which holds said stack of labels in a generally upright position;

a label feed assembly for grasping the first label in the stack of labels, moving it along the aforementioned path and positioning it in a predetermined position on the product, said label feed assembly comprising a pair of suction cups operable to grip said first label in said stack, a lever adapted to slide through pivot means secured to said channel assembly and an arm member having a pivotally movable end portion, said suction cups, lever and arm member being operatively associated with a drive mechanism for said machine, the lever being operatively associated with the suction cups so that upon action of the drive mechanism, the lever is adopted to cause said suction cups to grip said first label in said stack just above the transverse line along which the label is to be folded and then pivot said label about a transverse axis in the upper end of said label so that said lower end of said label moves upwardly and forwardly away from said stack and place the folded label in a proper position on said product;

means biasing said stack of labels towards said label feed assembly comprising a block member adapted to engage the last label in the said stack of labels and roller means adapted to engage the first label in the said stack of labels, said block member being biased by a spring loaded means and being adapted to move along a linear path by guide means within said channel assembly; and a label folding assembly positioned in the aforementioned path and cooperable with the feed assembly for folding the label along a transverse fold line as the feed assembly moves the label along said path, said folding assembly comprising a curved wiper member which is secured by pivot means within the channel adjacent the lower end of the said first label of the said stack of labels, latch means secured to said pivot means and stop means, said wiper member being biased by a spring in an initial position wherein the latch means engages the stop means and moving away from an initial position to a position away from said stack of labels upon the action of the drive mechanism whereupon the movable end portion of the arm member engage the latch means.

* * * * *